US006294052B1

(12) United States Patent
Garcia B.

(10) Patent No.: US 6,294,052 B1
(45) Date of Patent: Sep. 25, 2001

(54) EFFICIENT PRESS SECTION FOR PAPER MANUFACTURING

(76) Inventor: Jose J. Garcia B., #355-33-054, 9595 W. Quincy Ave., Littleton, CO (US) 80123

( * ) Notice: Subject to any disclaimer, the term of this patent is extended or adjusted under 35 U.S.C. 154(b) by 0 days.

(21) Appl. No.: 08/878,401

(22) Filed: Jun. 18, 1997

(51) Int. Cl.[7] ..... D21F 3/04

(52) U.S. Cl. ..... 162/360.3; 162/358.2; 162/360.2

(58) Field of Search ..... 162/360.3, 360.2, 162/358.2, 358.1

(56) References Cited

U.S. PATENT DOCUMENTS

| | | | | |
|---|---|---|---|---|
| 16,928 | * | 3/1857 | Koch | 162/360.3 |
| 58,051 | * | 9/1866 | Bingham | 162/360.3 |
| 1,599,503 | | 9/1926 | Tompkins . | |
| 2,209,757 | * | 7/1940 | Berry | 162/360.3 |
| 2,696,149 | | 12/1954 | Hornbostel . | |
| 3,149,025 | | 9/1964 | Dickens | 162/206 |
| 3,198,693 | | 8/1965 | Justus | 162/272 |
| 4,113,557 | | 9/1978 | Kankaanää | 162/301 |
| 4,224,372 | * | 9/1980 | Romanski | 162/900 |
| 4,526,655 | | 7/1985 | Karvinen et al. | 162/360.1 |
| 4,874,470 | | 10/1988 | Skaugen | 162/360.1 |
| 4,931,143 | | 6/1990 | Karvinen et al. | 162/360.1 |
| 5,002,638 | | 3/1991 | Gulya et al. | 162/206 |
| 5,091,056 | | 2/1992 | Autio | 162/360.1 |
| 5,256,257 | * | 10/1993 | Schiel | 162/360.3 |
| 5,389,205 | * | 2/1995 | Pajula et al. | 162/360.2 |
| 5,393,384 | | 2/1995 | Steiner et al. | 162/359.1 |

FOREIGN PATENT DOCUMENTS

| | | | | |
|---|---|---|---|---|
| 771159 | * | 12/1971 | (FR) | 162/360.3 |

* cited by examiner

*Primary Examiner*—Karen M. Hastings
(74) *Attorney, Agent, or Firm*—Robert M. Keller

(57) ABSTRACT

Embodiments of a new press section for paper manufacturing are disclosed, each having a combination of rolls which form at least two press nips, with one roll of each combination being common to two press nips. Also, said embodiments further include two continuous-loop belts, one made of absorbent felt material, the other of plastic sheet, both disposed in a manner to enhance the evacuation of water from a web of wet paper fiber.

2 Claims, 5 Drawing Sheets

180

EFFICIENT PRESS SECTION FOR PAPER MANUFACTURING

BACKGROUND OF THE INVENTION

1. Field of the Invention

The present invention relates to the art of paper manufacturing and, more particularly, an innovative press section for the manufacture of paper.

2. Description of the Prior Art.

Conventional papermaking machines generally comprise a web forming section, a press section, and a drying section. Typically, within a web forming section, wet celluosic material, commonly referred to as stock, is collected in a headbox and then sprayed or deposited as a web of wet paper material onto wires. From its formation at the output of the headbox, the web is carried on wires (which are part of an apparatus known as a "fourdrinier") where the moisture evacuation process begins. Out of the web forming section, the web enters the press section where the web continues to be shaped and formed into the desired product. Major functions of the press section include moisture evacuation, primarily through a combination of compression (which occurs while the web is "rolled" through press nips), absorption (which occurs while the web is transported by moisture-absorbent felt), and suction (through one or more vacuum devices). Out of the press section, the paper web is transferred to the dryer section where it is dried, mostly through heating and evaporation.

Within press sections, pressure and vacuum devices and combinations thereof are commonly used to extract moisture from the web: devices such as press nips, shoe presses, suction rolls, perforated surface or blinddrilled rolls, and vacuum boxes. The paper web is carried through the press section, including a series of press nips, on the surfaces of one or more belts. Much of the evacuation occurs by compression through press nips which are formed between opposing cylindrical rolls. Commonly used are blinddrilled rolls, rolls having imperforate roll shells covered with a myriad of "blind" drilled holes and/or recesses. Blinddrilled rolls channel moisture away as the web is drawn through press nips and compressed. Vacuum devices, commonly known as vacuum boxes and suction rolls, as may be installed on the downstream side of nips to draw water away from the nip and prevent felt remoisturizing.

Many improvements in press section design are directed to the problem of water evacuation. This is because evacuation by heating and evaporation through drying sections consumes more time and energy than evacuation by mechanical means in press sections. Even marginal increases in moisture evacuation by mechanical means, through press section improvements, can result in corresponding improvements in manufacturing time, energy consumption and overall manufacturing cost.

One example of a press section improvement is the invention disclosed by Karvinen in U.S. Pat. No. 4,931,143, entitled Press Section with Separate Press Nips in a Paper Machine, issued Jun. 5, 1990. Karvinen discloses a series of three successive press nips in a closed draw configuration. Significant features of Karvinen include two press nips succeeded downstream by an extended nip wherethrough the web is layered between a non-water receiving fabric, situated underneath the web, and a water-receiving fabric which is dedicated to the extended nip and situated above the web. The extended nip employs a shoe press which is recognized for improved moisture evacuation qualities.

Another example is disclosed by Steiner, et al in U.S. Pat. No. 5,393,384, entitled Paper Machine for the Production of Tissue Paper, issued Feb. 28, 1995. Steiner includes a press section having at least one shoe press, a device for separating the paper web from the press felt after one press pass, press felts dedicated to each press nip, and a water impermeable belt. Steiner combines the shoe press with its moisture evacuation qualities and a nonabsorbent belt which prevents remoisturizing of the paper web, thereby improving press section moisture evacuation qualities over designs of prior art.

Although there has been substantial progress in optimizing moisture extraction through improvements in press section design, such efforts have introduced or increased other inefficiencies encountered in the paper manufacturing process. For example, the separate, moisture-absorbent belts which are dedicated to particular press nips, as taught by Karvinen and Steiner, may actually increase the number of components and moving parts required. Consequently, such designs may actually increase overall maintenance and operating costs, while some may increase the floorspace requirements over press sections of more common design. Furthermore, where press section componentry is spread over larger areas, the draw of the paper web may similarly increase, thereby introducing greater risk of web tearing and other deformities and increasing the overall cost of manufacture. Many of the problems of prior art designs, together with their associated manufacturing inefficiencies, are overcome by the present invention.

BRIEF SUMMARY OF THE INVENTION

The present invention optimizes the evacuation of moisture through the press through efficient employment of cooperating blinddrilled and calender rolls. Press nips are formed by one or more pairs of cooperating rolls. Within each press nip, a blinddrilled roll serves to extract moisture by compression, collection and centrifugal force while providing an opposing, pressure force for its cooperating roll (which may be either another blinddrilled roll or a calender roll). In the inventive design, two press nips (or press nip "pairs") are formed from an assembly of three cooperating rolls, one roll being common to each nip of the pair. The common roll not only cooperates with both opposing rolls, but also draws the belt and the web away from the first nip and into the second nip of the pair. Two or more press nip pairs may be employed according to the particular manufacturing need. The paper web is carried through the inventive press section on the surface of a continuous loop belt made of absorbent felt material. Also, the web may be layered as it is drawn through the press nips: on one surface, by the aforementioned absorbent felt material, and on the other surface, by a belt of non-absorbent plastic sheet.

The present invention offers several innovative features which are further revealed in the description which follows. Among them is the "common roll" feature, described above, which enables greater efficiencies in the evacuation of moisture from web fiber. Another is an adaptable belt design comprising the combined use of absorbent felt and non-absorbent plastic belt material as may be determined by particular manufacturing needs. Also, in varying embodiments, the inventive press section can be adapted to employ one, two, or more press nips in succession according to manufacturing requirements. Additionally, the inventive approach enables the vertical stacking of multiple press nips, achieving greater economy of manufacturing floor space over press sections of more conventional design.

It is the primary objective of this invention to achieve a press section design having superior moisture evacuation qualities, resulting in considerable time and cost savings to the manufacturer. Secondary objectives include: (1) the achievement of greater mechanical efficiency with fewer components, thereby enabling greater reliability and reduced energy consumption over prior art designs; (2) a design having a closed draw of the paper web throughout the press section; (3) a compactness of design, thereby reducing the footprint of floor area required for manufacturing equipment; and (4) a flexible press section design, one which is easily adaptable to particular product and manufacturing needs. These and other desirable features of the inventive designs will become apparent to the knowledgeable reader through the course of this disclosure.

BRIEF DESCRIPTION OF THE DRAWINGS

Other objects of the present invention and many of the attendant advantages of the present invention will be readily accepted as the same becomes better understood by reference to the detailed description when considered in connection with the accompanied drawings in which like reference numerals designate like parts throughout the figures thereof and wherein:

FIG. 4 illustrates a preferred embodiment within the setting of a third plant for the manufacture of papers, particularly heavier grade paper.

PREFERRED EMBODIMENTS

Figure 1:
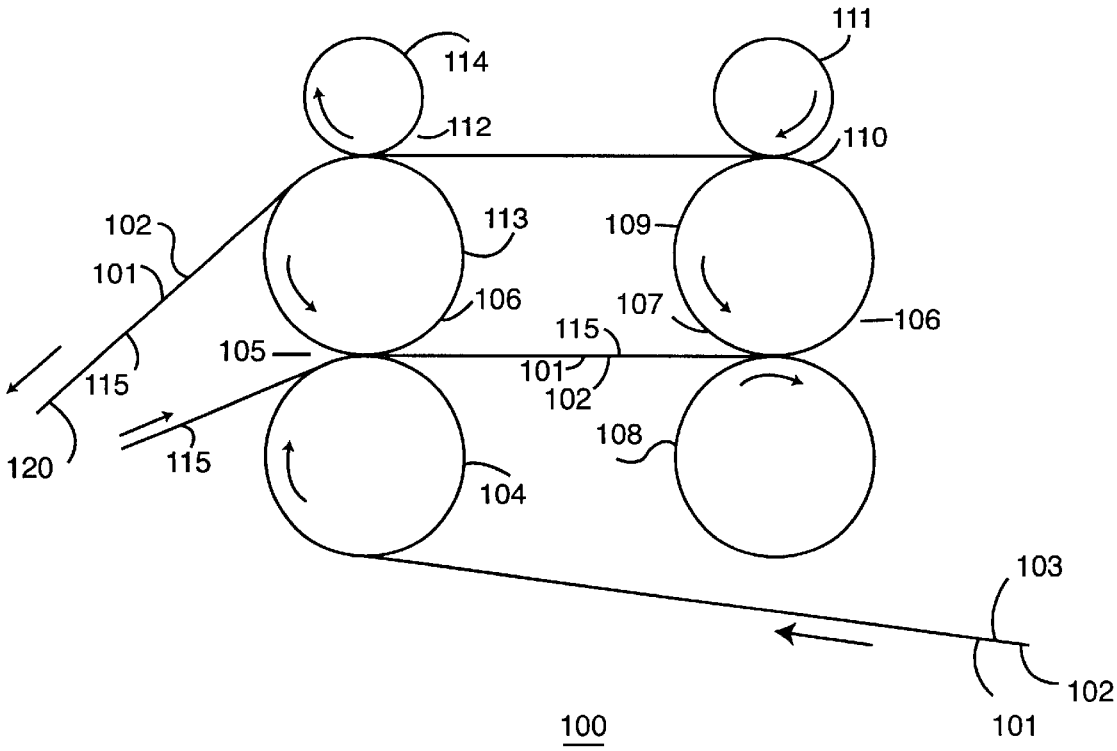
FIG. 1 is a schematic illustrating one preferred embodiment illustrating major features of the inventive press section. The configuration depicted in FIG. 1 comprises four blinddrilled rolls with the paper web entering the press section on the lower surface of a continuous loop belt made of absorbent felt material, together with a continuous loop belt made of plastic fabric.

FIG. 1 is a schematic illustrating a preferred embodiment 100 of the inventive press section. The paper web 101 enters the ingress 103 of the press section 100 on the lower surface of a continuous loop belt 102 (hereinafter "first belt") made of felt material. The web 101 and first belt 102 are drawn to the first blinddrilled roll 104 from underneath said roll 104. Then, the web 101 and belt 102 are drawn nearly 180 degrees along the surface of the first blinddrilled roll 104 and into the first press nip 105. The first press nip 105 is formed by a roll pair 106 consisting of the first 104 and fourth 113 blinddrilled rolls. The first 104 and fourth 113 blinddrilled rolls are disposed to cooperate with each other and provide adequate compression for the first press nip 105. At the entrance to the first nip 105 a second belt 115 of plastic sheet material joins the web 101 and belt 102. As the web 101 is drawn through the first press nip 105, the web 101 becomes layered between first belt 102 and second belt 115. Here, moisture is evacuated from the web 101 by compression of the press nip 105, in a manner well known to the art. Having passed through the first nip 105, the web 101 remains layered between first belt 102 and second belt 115, traveling to the second press nip 107. Said second press nip 107 is formed by a blinddrilled roll pair 106 consisting of the second 108 and third 109 blinddrilled rolls similarly cooperating. Again, moisture is mechanically evacuated from the web 101 by compression as the web 101, belt 102 and second belt 115 pass through the second press nip 107. Once through the second press nip 107, the first belt 102, web 101 and second belt 115 travel approximately 180 degrees around the rotating surface of the third blinddrilled roll 109. At this point, the web 101, which remains layered between first belt 102 and second belt 115, enters the third press nip 110. The third press nip 110 is formed by a first calender roll 111 , disposed to cooperate with the third blinddrilled roll 109 and, together, provide adequate compression for the paper web 101. Emerging from the third press nip 110, the web 101 remains layered between belt 102 and second belt 115 and travels to a fourth press nip 112. The fourth press nip 112 is formed by the fourth blinddrilled roll 113 and a second calender roll 114 similarly cooperating. Passing through the fourth press nip 112, moisture is again evacuated from the web 101 by compression. Emerging from the fourth press nip 112, the belt 102, web 101 and second belt 115 together exit the press section 100. Away from the press section 100, the web 101 continues to travel between the underneath surface of the first belt 102 and the upper surface of second belt 115, toward the egress 120 of the press section 100.

In a variation to the preferred embodiment 100, calender roll 111 and second calender roll 114 may be of types which are steam fed and well known to the art.

As a variation to the above described press section 100, and depending on particular manufacturing requirements, it is possible to omit two of the press nips, preferably the second and third press nips, 107 and 110, respectively. Accordingly, the second and third blinddrilled rolls, 108 and 109, respectively, and the first calender roll 111 are also omitted from this variation. With the omission of the second and third press nips 107, 110, the web 101 is routed to emerge from the first press nip 105, then travel along the rotating surface of the fourth blinddrilled roll 113 and into the fourth press nip 112. The web 101 then emerges from the press section 100 at the egress 120. Such variation is not illustrated.

Figure 2:
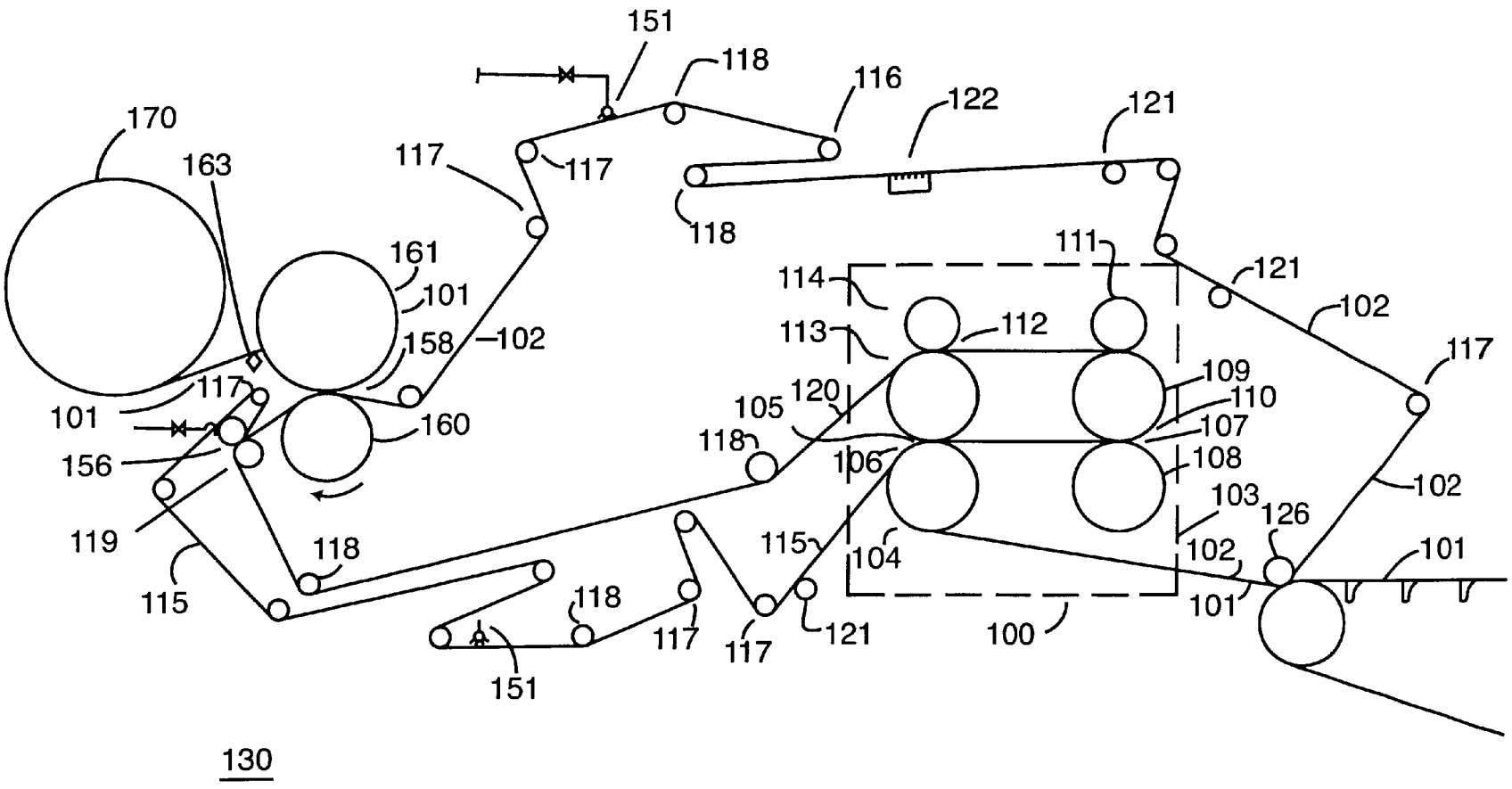
FIG. 2 is another schematic illustrating the preferred embodiment, as depicted in FIG. 1, within the setting of a plant for the manufacture of papers.

In FIG. 2, the preferred embodiment 100 is schematically illustrated within the broader setting of paper manufacturing plant 130. Within such context, the closed loop nature of both the first belt 102 and second belt 115 can be appreciated. Here, press section 100 as illustrated in FIG. 1 is identified by the broken line box. The layered "sandwich" of the first belt 102, web 101 and second belt 115 emerges from the egress 120 of press section 100, guided toward the dryer section 170. Upstream from the dryer section 170, the second belt 115 separates from the web 101 as the web 101 and first belt 102 emerge from suction pressure roll 119. The second belt 115 continues into a return path, being first exposed to a high pressure hot air shower 156 which helps lift the web 101. Second belt 115 subsequently reverses direction at a felt roll 117. Through its return path, the second belt is guided by guide rolls 118 and felt rolls 117, while being cleaned and stretched through a heated water spray from shower heads 151 and "uhle box" 121 (a pipe with an elongated slot). Downstream from the point where the second belt 115 separates from the web 101, the web 101 and first belt 102 continue through a fifth press nip 158 which is formed by a 48"ϕ dryer 161 and a plain rubber pressure roll 160. Note that, while the fifth press 158 is set apart from the press section 100 as illustrated, the elements of the fifth press nip 158, in combination, also form the claimed invention. Also, a blinddrilled roll may be substituted for the plain rubber pressure roll 160 of the fifth press nip 158). Immediately downstream from the fifth press nip 158, the web 101 and first belt 102 separate: the first belt 102 is directed into a return path, first along the rotating surface of press roll 160, while the web 101 travels along the surface of 48"ϕ dryer 161. After traveling approximately 270° on the rotating surface of 48"ϕ dryer 161, the web 101 is separated from the 48"ϕ dryer 161 by a doctor blade 163 and directed toward dryers 170. Meanwhile, the first belt 102 continues along its return path toward the ingress 103, being guided by a combination of felt rolls 117 and guide rolls 118. Through its return path, the first belt 102 is cleaned and stretched by a pressurized water shower 151, uhle boxes 121, vacuum boxes 122, and stretcher roll 116.

The FIG. 2 schematic illustrating paper manufacturing plant 130 is adaptable for the manufacture of lightweight or heavier grade papers. For lightweight papers such as tissue paper, a Yankee-style dryer which is depicted in the drawing by dryer 170 is the preferred method of drying. For heavier grade papers, the dryer 170 becomes a series of several offset, counter-rotating dryers.

Figure 3:
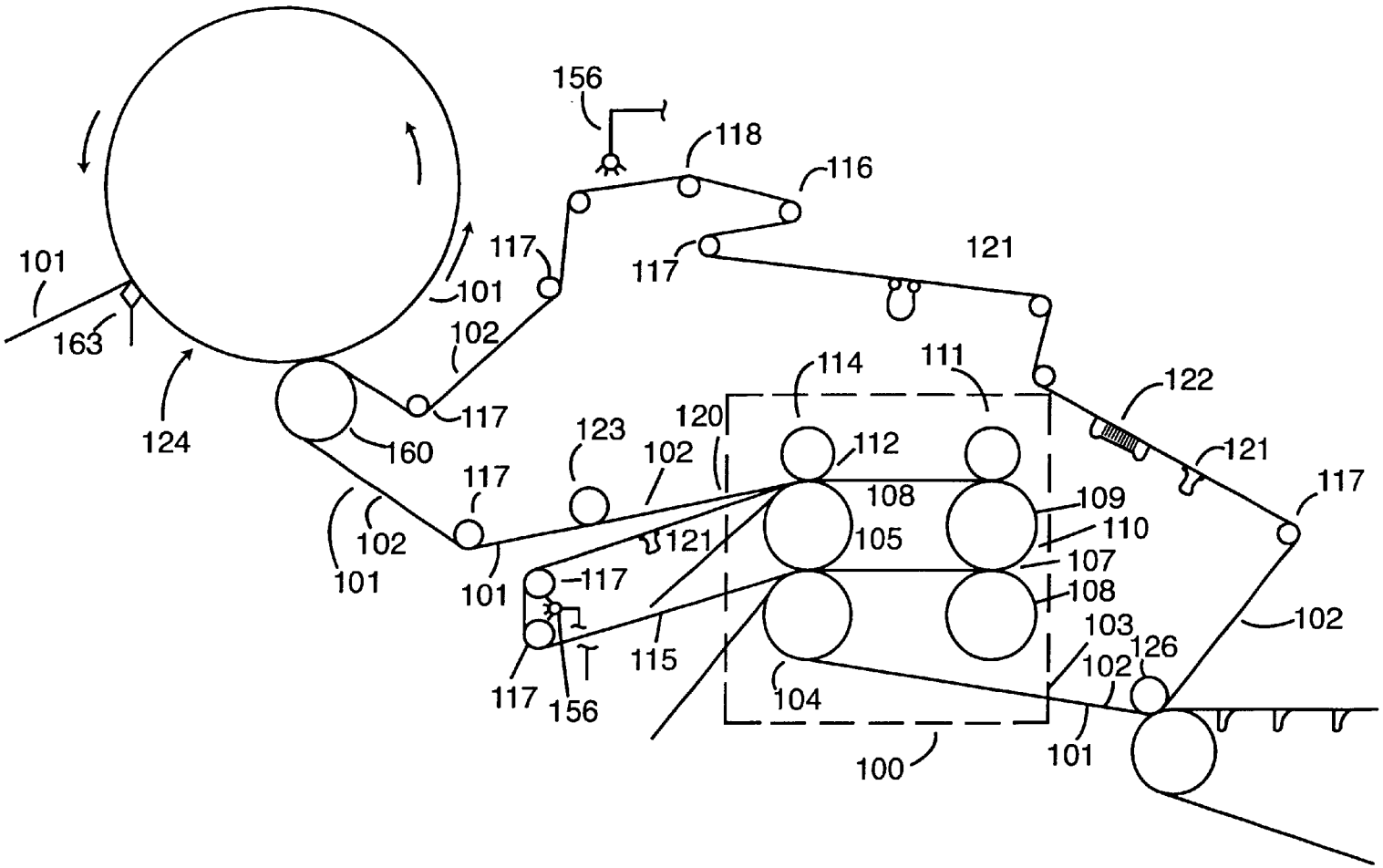
FIG. 3 is a schematic illustrating the preferred embodiment, depicted in FIG. 1, but within the setting of a second plant for the manufacture of papers.

FIG. 3 depicts a second paper manufacturing plant 140, another setting for a preferred embodiment of the inventive press section 100. In the second plant 140, the second belt 115 separates from the web 101 and first belt 102 at the egress 120 of the inventive press section 100, at which point the second belt 115 enters into a return loop. In its return loop, the second belt 115 is guided and stretched by felt rolls 117 as the second belt 115 is directed past a uhle box structure 121 which sprays a high pressure hot air to the second belt 115 and web 101, a process which prepares the web 101 for separation from the second belt 115. A suction roll 123 is positioned near the egress 120 to assist in lifting the first belt 102 and web 101 away from the second belt 115. A felt roll 117 then guides the first belt 102 and web 101 toward a blinddrilled pressure roll 160 which is disposed adjacent to and cooperates with the Yankee dryer 124. The first belt 102 and web 101, then traveling together along the rotating surface of the blinddrilled pressure roll 160, are separated as the exposed surface of the web 101 reaches the dryer 124. At this point, the web 101 travels approximately 270 degrees along the surface of the Yankee dryer 124 and then separates from the dryer 124 with the aid of a doctor blade 163. Meanwhile, the first belt 102 is directed away from the dryer 124 by a series of felt rolls 117 as is depicted in FIG. 3. In its return path, the first belt is stretched and cleaned by components such as a high pressure hot water shower 156, guide roll 118, felt rolls 117, a stretch roll 116, uhle boxes 121, and a vacuum box 122 (all in manners well known to the art). The first belt 102 is then directed toward pick-up roll 126 and the web 101, once again entering the inventive press section 100 at the ingress 103.

Figure 4:
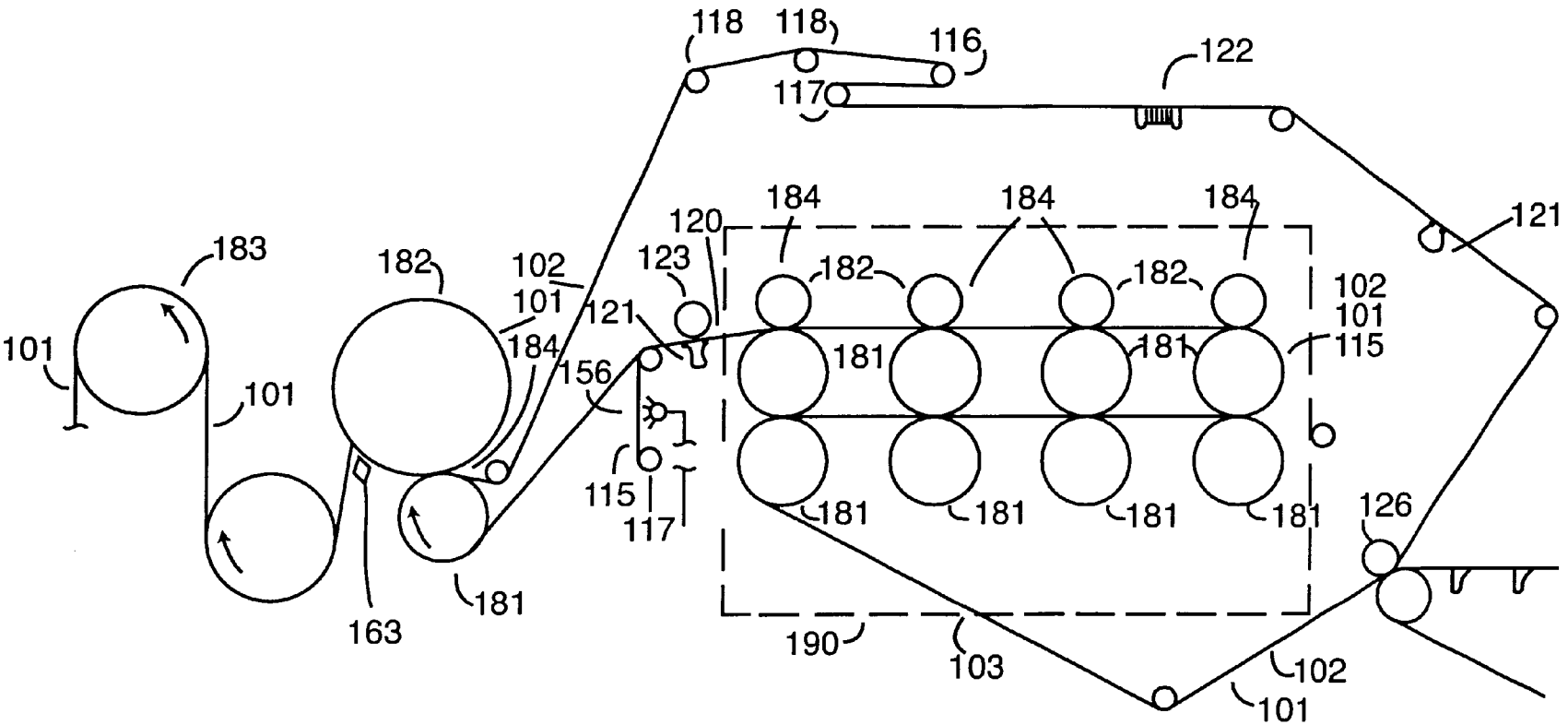
FIG. 4 depicts, in schematic, a variation of the preferred embodiment show in FIG. 1. Said variation demonstrates the expandability and adaptability of the inventive press section to particular manufacturing needs.

FIG. 4 depicts another preferred embodiment of the inventive press section 190. Press section 190, which is similar to the above described press section 100 and presented in the setting of a heavy-grade paper manufacturing plant 180. Attention is directed to a combination 184 of three, vertically-stacked cooperating rolls, comprising two blinddrilled rolls 181 and one steam-fed calender roll 182. This combination 184 is repeated within the press section 190 four times. It can be appreciated that each additional combination 184 increases the number of press nips by two for every combination 184 so added. Although the FIG. 4 diagram depicts only four such combinations 184, the number of combinations 184 may be increased or decreased according to particular manufacturing needs. Attention is now directed to the point where the layered first belt 102, web 101, and second belt 115 together emerge from the egress 120. Here, the belt-web "sandwich" is exposed, on one side, to an uhle box 121 (applying pressurized hot air) and, directly opposite, a suction roll 123. Together, the uhle box 121 and suction roll 123 aid the subsequent separation of the web 102 from the second belt 115. Just downstream, the second belt 115 is lifted away from the web 101 and guided in its return toward press section 190 by felt roll 117. Also, the second belt 115 is exposed to a high pressure hot water shower 156 as it returns. Attention is now directed upstream from the high pressure hot water shower 156 to the point where the second belt 115 separates from the web 101. Here, the web 101 and first belt 102 continue together toward one final nip 184, which is formed by a plain pressure rubber roll 181 cooperating with a common 48"ϕ dryer 182. The web 101 and first belt 102 separate as they emerge from press nip 184, the web 101 clinging to the 48"ϕ dryer 182. While the web 101 continues along the surface of the 48"ϕ dryer 182, the first belt 102 is directed into its return path. A doctor blade 163 is disposed adjacent to the 48"ϕ dryer 182, causing the web 101 to separate from the 48"ϕ dryer 182. Here, the web 101 is directed toward a dryer section. Meanwhile, the first belt 102 continues in return path in a manner similar to that of FIG. 2.

Figure 5:
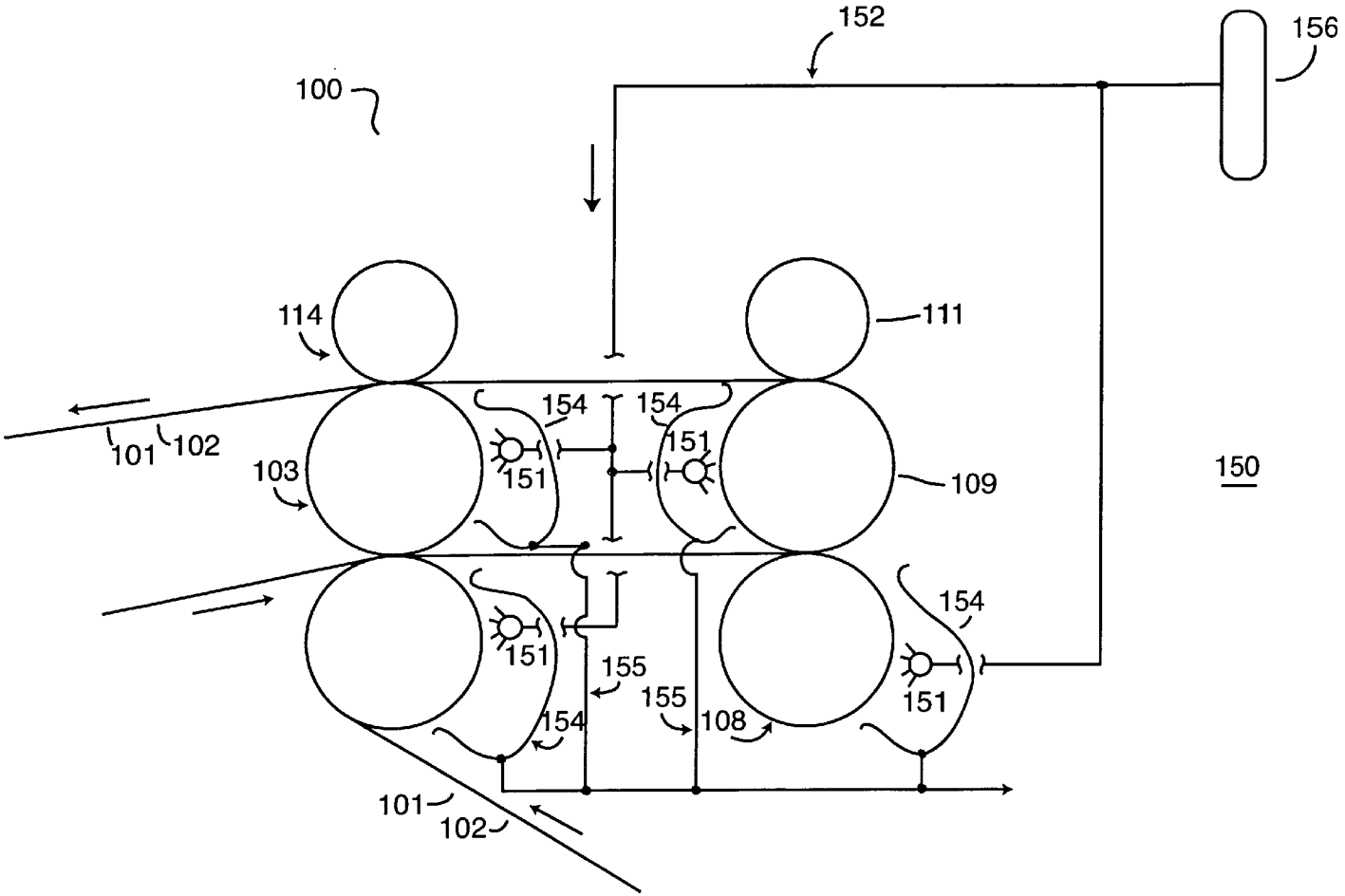
FIG. 5 depicts, in schematic form, a pressure cleaning assembly which is recommended for cleaning waste material from blinddrilled rolls. The pressure cleaning assembly so described is adaptable to preferred embodiments and other variations of the claimed invention.

FIG. 5 depicts, in schematic form, a pressure cleaning assembly 150 which is recommended for cleaning waste material from blinddrilled rolls. In the example illustrated, the pressure cleaning assembly 150 is adapted to the preferred embodiment of inventive Press Section 100. The pressure cleaning assembly 150 comprises a water supply 156, a feed system 152, high pressure shower heads 151, and drain system 154. The water supply 156 may have, as its source, heated, pressurized water drawn from an external boiler or heat exchanger. The feed system 152 directs heated, pressurized water from the water supply 156 to the high pressure shower heads 151. The feed system 152 and drain system 153 are disposed clear of contact with the web 101, first belt 102 and other press section 100 components. High pressure shower heads 151 are suspended from the feed system 152 with their spray directed toward blinddrilled rolls 104, 108, 109 and 114. The drain system 153, comprising catch basins 154 and drain lines 155, is configured to capture excess water and any waste material removed from blinddrilled rolls 104, 108, 109 and 114. The drain system 154 is also configured to prevent remoisturization of the web 101. Pressure cleaning assembly 150 may be adaptable to all the preferred embodiments described herein.

In all of the preferred embodiments, chemical washes, vacuum and spray devices or scraping devices may be used throughout the press section. Also, devices for collecting and evacuating moisture and residue may be installed in and around each press nip in manners similar to those described above and well known to the art.

It can be appreciated that goals of the present invention are achieved by each of the aforementioned preferred embodiments. First, the unique approach, wherethrough two press nips share a common press roll, results in a more compact, more efficient design which employs fewer movable components (as compared to press sections of the prior art having like numbers of press nips). Second, whereas webs of prior art designs more commonly travel in a forward-moving direction (without changing their direction of forward movement), the web and belt of the inventive press section are guided to loop back, moving generally in a direction opposite the forward direction as they enter the first press nip, only to reverse their travel a second, third, or fourth (or more) time before being guided through the final press nip of their series. Such efficient routing of the web enables a more compact layout, thereby achieving economies of manufacturing floorspace. Third, in each of the preferred embodiments, it can be appreciated that the press nips are vertically stacked, further contributing to an efficient use of space. Also, each of the preferred embodiments employ a closed draw of the paper web, thereby enhancing overall productivity as well as quality of the finished product. Finally, greater flexibility is achieved through the stacking of press nips and other features described herein. The aforementioned features, both separately as well as in combination, result in a more mechanically efficient, energy-saving, and compact press sections as compared to press sections of the prior art.

This invention has been described herein in considerable detail in order to comply with the Patent Statutes and to provide those skilled in the art with the information needed to apply the novel principles and to construct and use such specialized components as are required. However, while a particular embodiment of the present invention has been described herein in detail, it is to be understood that various alterations, modifications and substitutions can be made therein without departing from the spirit and scope of the present invention, as defined in the following

I claim:

1. A paper making press section, comprising:

(a) a conveying means for transporting a web of wet paper fiber, the conveying means comprising a first belt having moisture absorbent material, the first belt forming a continuous loop;

(b) a first and a second press nip assembly, each press nip assembly comprising at least three cooperating, cylindrical press rolls disposed in parallel along a common plane, the first and the second press nip assemblies disposed substantially in parallel:

each of said rolls having an outer surface and a lengthwise axis, each of said rolls rotatable about said axis;

said rolls further disposed in close proximity, forming a first and a second press nip;

said press nips comprising a compression point between the outer surfaces of two of said rolls, wherethrough said first belt is directed;

within each press nip assembly, at least one roll being common to the first and second press nips;

said outer surfaces selected from a group consisting of: a smooth surface, a perforated surface, a blinddrilled surface, and a surface having depressions;

(c) an ingress;

(d) an egress; and (e) a second belt the second belt being movable, disposed to travel through the first and second press assemblies;

the second belt cooperating with said conveying means as the second belt travels through said press assemblies;

the second belt comprising non-water absorbent plastic sheet;

said first and second press nip assemblies disposed between said ingress and said egress; whereby said web is layered between the second belt and said first belt as the second belt travels through said press nips, and whereby said conveying means receives said web at said ingress, continuously transports the web first through the first press nips of the first and second press assemblies, then through the second press nips of the first and second press assemblies, and then separates from the web at said egress.

2. The press section of claim 1:

wherein said conveying means further comprises a plurality of guide rolls, a means for cleaning said first belt, and a means for dewatering said first belt;

and wherein the press section further comprises a means for cleaning said second belt and a means for stretching said second belt.

* * * * *